US006471490B2

(12) United States Patent
Kimura et al.

(10) Patent No.: US 6,471,490 B2
(45) Date of Patent: Oct. 29, 2002

(54) PISTON TYPE COMPRESSOR HAVING SUCTION STRUCTURE WITH ARCUATELY SHAPED SUCTION VALVE

(75) Inventors: Naofumi Kimura, Kariya (JP); Masakazu Obayashi, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/847,211

(22) Filed: May 2, 2001

(65) Prior Publication Data

US 2001/0041141 A1 Nov. 15, 2001

(30) Foreign Application Priority Data

May 12, 2000 (JP) ..... 2000-139815

(51) Int. Cl.[7] ..... F04B 1/26; F04B 1/12; F04B 39/10; F16K 15/16

(52) U.S. Cl. ..... 417/222.1; 417/269; 417/571; 417/569; 137/856

(58) Field of Search ..... 417/222.1, 222.2, 417/269, 571, 569; 137/856, 855

(56) References Cited

U.S. PATENT DOCUMENTS 4,764,091 A * 8/1988 Ikeda et al. ..... 417/269
4,976,284 A * 12/1990 Hovarter ..... 137/856
5,147,190 A * 9/1992 Hovarter ..... 417/571
6,293,763 B1 * 9/2001 Yokomachi et al. ..... 417/269

FOREIGN PATENT DOCUMENTS

| | | |
|---|---|---|
| EP | 0 962 655 A2 | 12/1999 |
| JP | A-57-97974 | 6/1982 |
| JP | A-8-28449 | 1/1996 |

* cited by examiner

*Primary Examiner*—Charles G. Freay
*Assistant Examiner*—Michael K. Gray
(74) *Attorney, Agent, or Firm*—Woodcock Washburn LLP

(57) ABSTRACT

A suction port of a piston type compressor is formed in the shape similar to a portion of a sector with an apex portion of the sector removed. A distal end portion of a suction valve which can open and close the suction port has a contour line including a distal end forming line extending generally parallel to a distal end line of the suction port, and side lines. A gap between the distal end line of the suction port and the distal end forming line of the suction valve is substantially constant, and a gap between the distal end forming line and the circle of the cylinder bore is substantially constant. The ease of the inflow of a gas when the gas is sucked from the suction port to the cylinder bore is improved.

10 Claims, 10 Drawing Sheets

PISTON TYPE COMPRESSOR HAVING SUCTION STRUCTURE WITH ARCUATELY SHAPED SUCTION VALVE

BACKGROUND OF THE INVENTION

1. Field of the Invention

The present invention relates to a piston type compressor having a suction structure with a suction valve, capable of flexural deformation for opening and closing a suction port, for sucking a gas from the suction port into a cylinder bore, by pushing the suction valve to open under a sucking operation of each piston in the cylinder bore.

2. Description of the Related Art

When a gas is sucked from a suction chamber into a cylinder bore in a piston type compressor, the facility or ease of the inflow of the gas greatly affects volumetric efficiency.

A suction port disclosed in Japanese Unexamined Patent Publication (Kokai) No. 57-97974 is circular and a suction port disclosed in Japanese Unexamined Patent Publication (Kokai) No. 2000-54961 is somewhat rounded and substantially triangular. A gas passing through the suction port from a suction chamber towards a cylinder bore exclusively flows in a direction perpendicular to a contour line of the suction port, as viewed from the reciprocating direction of a piston, (the circular port in Japanese Unexamined Patent Publication (Kokai) No. 57-97974 and the rounded triangular port in No. 2000-54961) and enters the cylinder bore. The opening gap of the suction valve relative to the valve plate becomes progressively greater towards the distal end of the suction valve. It is therefore effective to let the gas passing through the suction port flow in the longitudinal direction of the suction valve from its distal end side in order to improve facility of the inflow of the gas. The gas passing through the suction port exclusively flows in the direction perpendicular to the contour line that forms the hole of the suction port. Therefore, it can be said in connection with the contour line of the suction port that the greater the length of the contour on the distal end side of the suction valve, the easier it becomes for the gas to flow towards the distal end side of the suction valve. The suction port described in Japanese Unexamined Patent Publication (Kokai) No. 2000-54961 is superior to the circular suction port described in Japanese Unexamined Patent Publication (Kokai) No. 57-97974 because the gas passing through the suction port can flow more easily from the distal end side of the suction valve in its longitudinal direction in the former than in the latter. Therefore, the ease of the inflow of the gas is higher in the suction port of Japanese Unexamined Patent Publication (Kokai) No. 2000-54961 than in the circular suction port of the Japanese Unexamined Patent Publication (Kokai) No. 57-97974.

The position of the suction port in the circle of the circumferential surface of the cylinder bore as viewed in the reciprocating direction of the piston is close to a circumferential line of the circle of the cylinder bore, based on the relationship with the discharge port. In the contour line of the suction port described in Japanese Unexamined Patent Publication (Kokai) No. 2000-54961, a portion of the contour line close to the circumferential line of the circle of the cylinder bore is spaced apart, progressively, from the circumferential line of the circle of the cylinder bore as it extends away to the right and left from the center line of the suction port (represented by X in the drawing). The degree of separation is smaller, in comparison, than in the case of the circular suction port. The gas can more easily flow from the distal end side of the suction valve in its longitudinal direction in the suction port described in Japanese Unexamined Patent Publication (Kokai) No. 2000-54961 than in the circular suction port. Therefore, as to ease of the inflow of the gas, the suction port of Japanese Unexamined Patent Publication (Kokai) No. 2000-54961 is superior to the circular suction port of Japanese Unexamined Patent Publication (Kokai) No. 57-97974.

The construction in which the portion of the contour line close to the circumferential line of the circle of the cylinder bore is spaced apart progressively to the right and left from the center line of the suction valve makes it easy for the gas flowing in a direction crossing the portion of the contour line close to the circumferential line of the circle of the cylinder bore to flow in the direction of the circumferential line of the circle of the cylinder bore. However, such a flow of the gas is not desirable from the aspect of the ease of the inflow of the gas into the cylinder bore.

SUMMARY OF THE INVENTION

The object of the present invention is to provide a piston type compressor which can improve the ease of the inflow of the gas when the gas is sucked from the suction port to the cylinder bore.

To accomplish this object, the present invention provides a piston type compressor comprising a housing having cylinder bores, a suction chamber, a discharge chamber, suction ports and discharge ports formed therein, pistons reciprocatingly arranged in the cylinder bores, a drive shaft rotatably supported by the housing, a transmission mechanism operatively coupled to the drive shaft and the pistons for converting rotation of the drive shaft into reciprocal movement of the pistons, suction valves to open and close the suction ports, and discharge valves to open and close the discharge ports. The suction valve has a proximal end portion and a distal end portion on the opposite side of the proximal end portion, the distal end portion of the suction valve having an outer contour line including a distal end forming line located near a circumferential surface of the cylinder bore and side lines located on either side of the distal end forming line, the suction port having a contour line including a distal end line located near the circumferential surface of the cylinder bore and side lines located on either side of the distal end line. The distal end forming line of the suction valve and the distal end line of the suction port are arranged along the circumferential surface of the cylinder bore, so that a gap between the distal end forming line and the distal end line with respect to a radial line of a circle forming the circumferential surface of the cylinder bore is substantially constant and a gap between the distal end forming line and the circumferential surface of the cylinder bore with respect to the radial line is substantially constant.

The construction in which the gap between the distal end forming line of the suction valve and the distal end line of the suction port and the gap between the distal end forming line and the circumferential surface of the cylinder bore are substantially constant makes it easier for the gas to flow between the circumferential surface of the cylinder bore and the distal end forming line of the suction valve in a returning direction of the piston. Such a gas flow is desirable for improving ease of the inflow of the gas into the cylinder bore.

Preferably, an average of the gap between the circumferential surface of the cylinder bore and the outer end forming line of the suction valve is greater than a gap between the suction valve and the distal end line of the suction port under a maximum valve open condition.

The gas that flows between the suction valve and the distal end line of the suction port so as to perpendicularly impinge against the circumferential surface of the cylinder bore can more easily flow between the circumferential surface of the cylinder bore and the distal end forming line of the suction valve in the returning direction of the piston.

Preferably, a middle line is provided which passes through a middle point of a maximum length of the suction port in a longitudinal direction of the suction valve, extends transversely with respect to the suction port and crosses a reference line extending in the longitudinal direction of said suction valve, the middle line dividing the suction port into a first section positioned on the side of the proximal end portion of the suction valve and a second section positioned on the side of the distal end of the suction valve, an area of the second section being greater than an area of the first section.

The construction in which the area of the second section is greater than the area of the first section makes it easier for the gas passing through the suction port to flow from the distal end side of the suction valve.

Preferably, a width increasing region is disposed in which the width of the suction port in a direction of the middle line becomes gradually greater from the proximal end side to the distal end side of the suction valve in the longitudinal direction of the suction valve, and the length of the width increasing region in the direction of the reference line occupies a major part of the maximum length of the suction port in the direction of the reference line.

The existence of the width increasing region makes it easier for the gas passing through the suction port to flow towards the distal end side of the suction valve.

Preferably, a maximum width of the suction port in the direction of the middle line exists in the second section and is greater than the maximum length of the suction port in the direction of the reference line.

The construction in which the maximum length of the suction port in the direction of the reference line is smaller than the maximum width of the suction port in the direction of the middle line and the maximum width of the suction port in the direction of the middle line exists on the side of the second section is convenient for increasing the length of the contour line of the suction port on the distal end side of the suction valve.

Preferably, the contour line of the suction port includes a proximal end line positioned on the side of the proximal end of the suction valve, said distal end line and a pair of right and left side lines, and the distal end line is longer than the proximal end line.

The construction wherein the length of the distal end line is greater than that of the proximal end line makes it easier for the gas passing through the section port to flow towards the distal end side of the suction valve.

Preferably, the contour line of the suction port includes a pair of first connection lines connecting the proximal end line to the pair of side lines and a pair of second connection lines connecting the distal end line to the pair of side lines, the pair of first connection lines being smoothly connected to the proximal end line and the pair of said side lines, the pair of second connection lines being smoothly connected to the distal end line and the pair of side lines.

Preferably, the contour line of the suction port is an annular line with no corner. The construction wherein the contour line of the suction port is an annular line with no corner is advantageous for preventing backflow of the gas from the cylinder bore to the suction port.

Preferably, the contour line of the suction port is an annular convex line with no corner.

Preferably, the reference line extends substantially along the radial line of the circle of the circumferential surface of the cylinder bore.

The construction wherein the reference line extends substantially along the radial line of the circle of the circumferential surface of the cylinder bore is advantageous for bringing the contour line of the suction port on the distal end side of the suction valve closer to the circle of the circumferential surface of the cylinder bore.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

The first embodiment of the present invention applied to a variable capacity type compressor will now be explained with reference to FIGS. 1A to 5.

Figure 5:
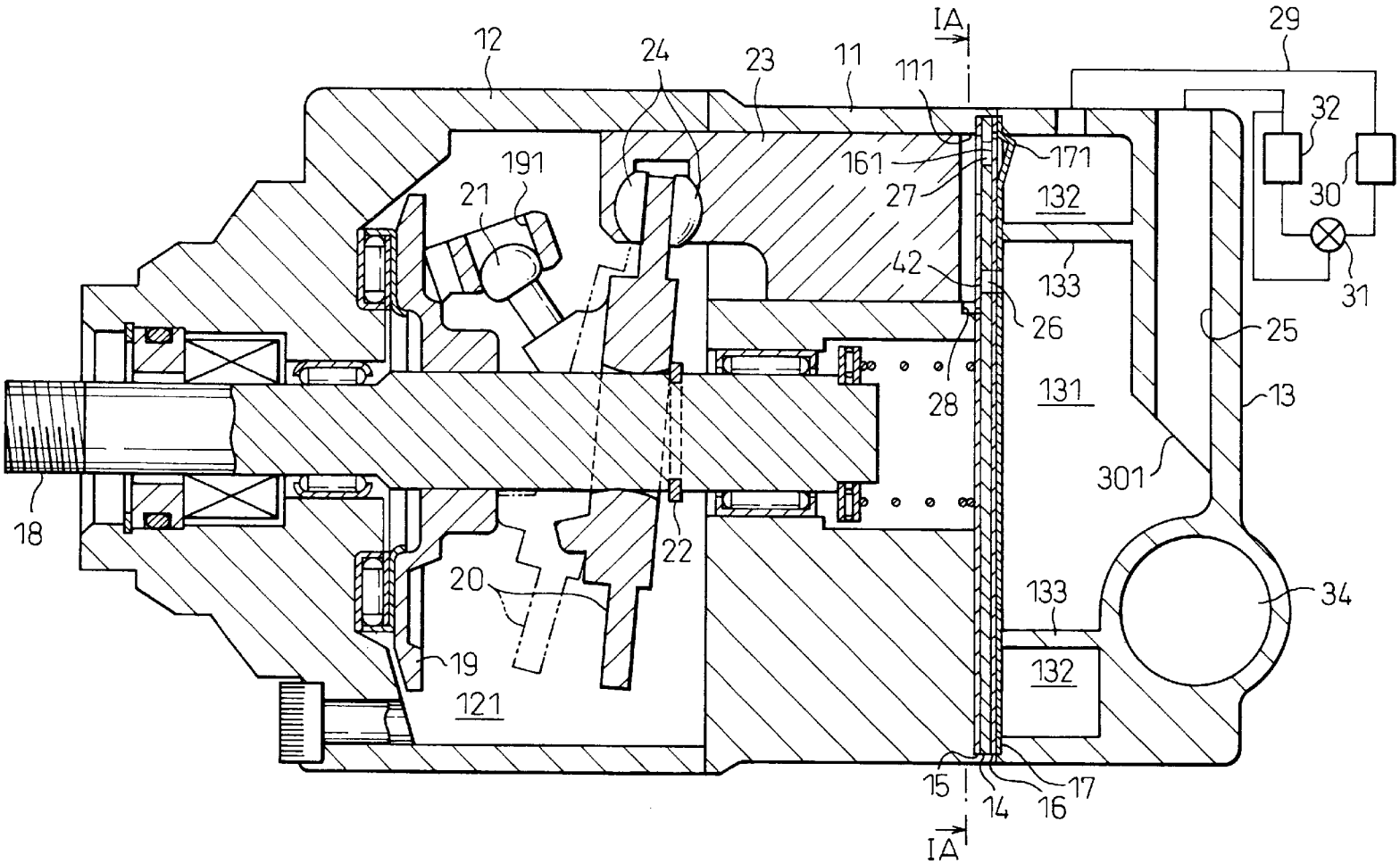
FIG. 5 is a sectional view of a portion of a compressor according to the embodiment of the present invention.

Referring to FIG. 5, a front housing 12 is coupled to the front end of a cylinder block 11, and a rear housing 13 is fixed to the rear end of the cylinder block 11 via a partition plate 14, valve-forming plates 15 and 16 and a retainer-forming plate 17. A drive shaft 18 is rotatably supported by the front housing 12 and the cylinder block 11 which together form a control pressure chamber 121. The drive shaft 18 protruding outward from the control pressure chamber 121 receives a driving force from an external driving source such as a car engine (not shown) through a pulley (not shown) and a belt (not shown).

A rotation support member 19 is anchored to the drive shaft 18. The drive shaft 18 supports a swash plate 20 in such a fashion that the swash plate 20 can slide in an axial direction with respect to the drive shaft 18 and can incline. The swash plate 20 can incline with respect to the axis of the drive shaft 18 and can rotate with the drive shaft 18, by the cooperation of a pair of guide pins 21 fixed to the swash plate 20 and a pair of guide holes 191 in the rotation support member 19. The inclination movement of the swash plate 20 is guided by the slide guide relation between the guide hole 191 and the guide pin 21 as well as the slide support operation of the drive shaft 18.

When the radial center portion of the swash plate 20 moves towards the rotation support member 19, the angle of inclination of the swash plate 20 increases. When the radial center portion of the swash plate 20 moves towards the cylinder block 11, the angle of inclination of the swash plate decreases. The minimum angle of inclination of the swash plate 20 is defined by the abutment of a circlip 22 fitted to the drive shaft 18 against the swash plate 20. The maximum angle of inclination of the swash plate 20 is defined by the abutment of the rotary support member 19 against the swash plate 20. The position of the swash plate 20 indicated by the solid line represents the position of the minimum angle of inclination of the swash plate 20. The position of the swash plate 20 indicated by the chain line represents the position of the maximum angle of inclination of the swash plate 20.

Figure 1A:
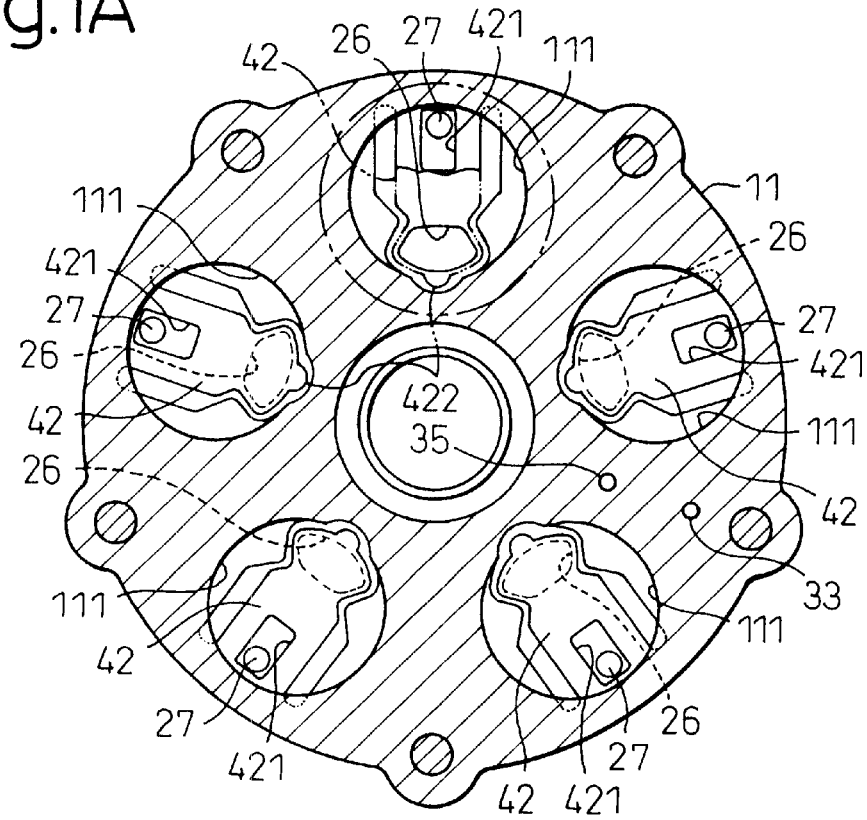
FIG. 1A is a sectional view of a compressor according to the first embodiment of the present invention, taken along the line IA—IA in FIG. 5.

As shown in FIG. 1A, a plurality of cylinder bores 111 (five, in this embodiment) are formed in the cylinder block 11. The cylinder bores 111 are disposed equidistantly about the drive shaft 18. Pistons 23 are arranged in the cylinder bores 111, as shown in FIG. 5. The rotating motion of the swash plate 20 is converted into the reciprocating motion of the pistons 23 through shoes 24, and the pistons 23 move back and forth in the cylinder bores 111.

A suction chamber 131 and a discharge chamber 132 are defined in the rear housing 13. The discharge chamber 132 surrounds the suction chamber 131 through a partition wall 133. A supply passage 25 is arranged in the rear wall of the rear housing 13.

Figure 2:
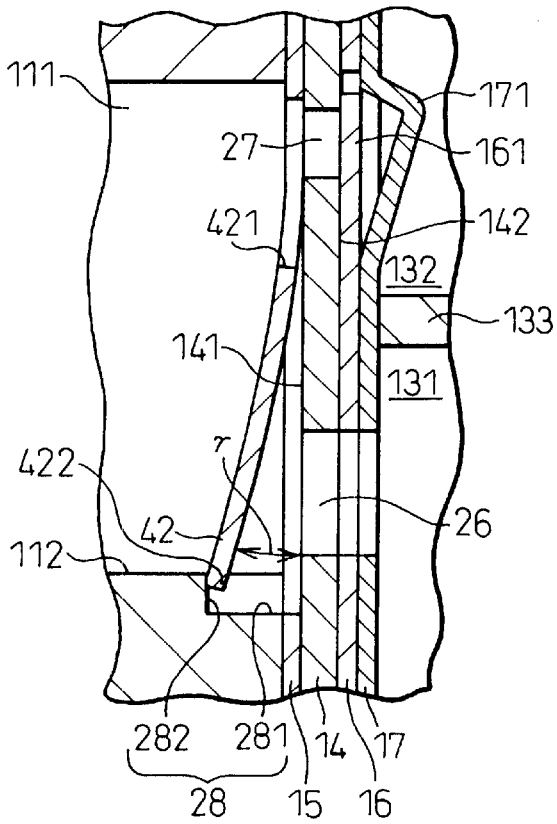
FIG. 2 is a sectional view of the compressor, taken along line II—II in FIG. 1B.

As shown in FIGS. 2 and 5, suction ports 26 are formed in the partition plate 14, the valve-forming plate 16 and the retainer-forming plate 17 corresponding to the cylinder bores 111. Discharge ports 27 are formed in the partition plate 14 at positions corresponding to cylinder bores 111. Suction valves 42 are formed in the valve-forming plate 15, and discharge valves 161 are formed in the valve-forming plate 16. Each of the suction valves 42 and the discharge valves 161 is integral with the associated valve-forming plate, and is thus fixed at its proximal end to the valve-forming plate while the substantial part thereof is flexible. A window 421 is formed in the proximal end portion of the suction valve 42 corresponding to the discharge port 27. The distal end portion of the suction valve 42, that undergoes flexural deformation, comes into, and out from, contact with the contact surface 141 of the partition plate 14 on the one side thereof and opens and closes the suction port 26. The distal end portion of the discharge valve 161, that undergoes flexural deformation, comes into, and out from, contact with the contact surface 142 of the partition plate 14 on the other side thereof and opens and closes the discharge port 27.

Figure 1B:
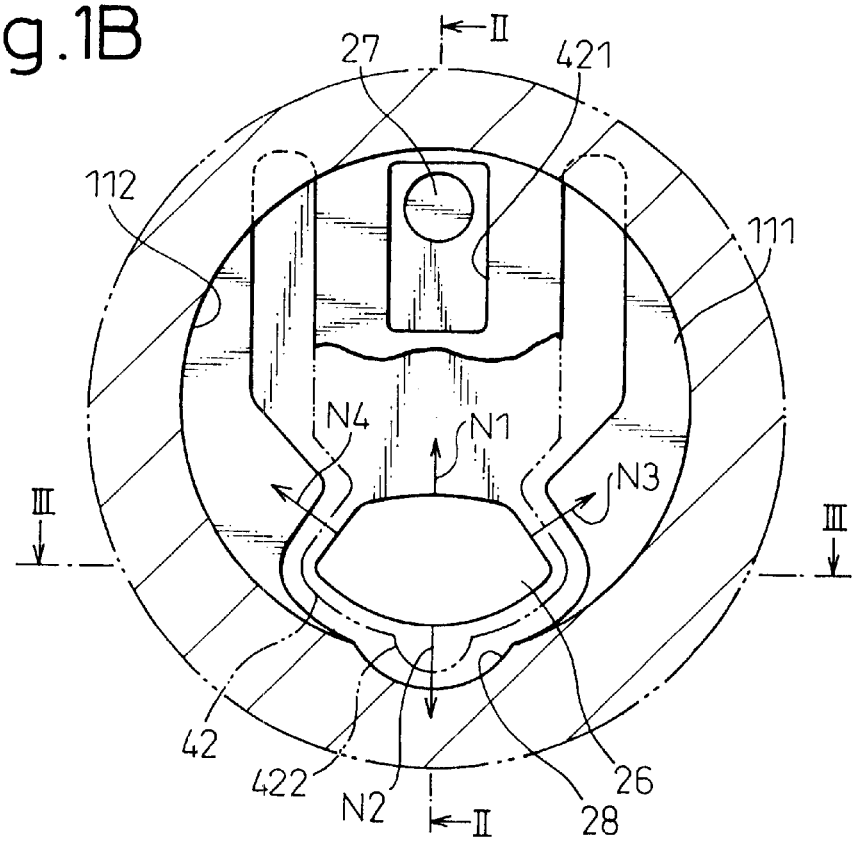
FIG. 1B is an enlarged sectional view of a portion of FIG. 1A.
Figure 3:
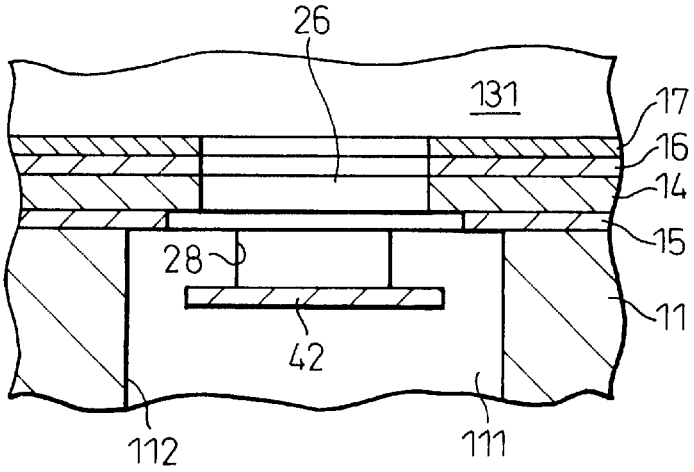
FIG. 3 is a sectional view of the compressor, taken along the line III—III in FIG. 1B.

As shown in FIGS. 1B and 2, a maximum opening limiting recess 28 is formed in each cylinder bore 111. The maximum opening limiting recess 28 has a side surface 281 and a bottom surface 282. The side surface 281 of the maximum opening limiting recess 28 is a circular circumferential surface. An engaging projection 422 having a semi-circular arcuate shape is formed at the distal end of the suction valve 42. As shown in FIG. 2, the engaging projection 422 can abut against the bottom surface 282 of the maximum opening limiting recess 28, and the maximum opening limiting recess 28 defines the maximum opening of the suction valve 42. FIG. 3 shows the maximum opening condition of the suction valve 42.

A refrigerant gas in the suction chamber 131 is sucked through the suction port 26 into the cylinder bore 111, pushing the suction valve 42, during the returning movement (movement from the right to the left in FIG. 5) of the piston 23. The refrigerant gas in the cylinder bore 111 is discharged through the discharge port 27 into the discharge chamber 132, pushing the discharge valve 161 during the forward movement (movement from the left to the right in FIG. 5) of the piston 23. As the discharge valve 161 comes into contact with the retainer 171 on the retainer-forming plate 17, its opening is restricted. The coolant discharged into the discharge chamber 132 is fed to a condenser 30, an expansion valve 31 and an evaporator 32 on an external refrigerant circuit 29 outside the compressor and returned to the suction chamber 131 from the supply passage 25.

A solenoid-operated capacity control valve 34 is arranged in a pressure feed passage 33 (shown in FIG. 1A) that connects the discharge chamber 132 to a control pressure chamber 121. The pressure feed passage 33 supplies the refrigerant gas in the discharge chamber 132 to the control pressure chamber 121. The solenoid-operated capacity control valve 34 is activated and inactivated by a controller (not shown), which controls activation and deactivation of the solenoid-operated capacity control valve 34 based on a detected compartment temperature detected by a compartment temperature sensor (not shown) detecting a compartment temperature of the car and a target compartment temperature set by a compartment temperature setter (not shown).

The refrigerant gas in the control pressure chamber 121 flows out to the suction chamber 131 through a pressure release passage 35 (shown in FIG. 1A). When the solenoid-operated capacity control valve 34 is in the deactivated condition, the refrigerant gas in the discharge chamber 132 is not delivered to the control pressure chamber 121. Therefore, the pressure difference between the control pressure in the control pressure chamber 121 and the suction pressure on opposite sides of the piston 23 becomes smaller, and the inclination angle of the swash plate 20 shifts towards the maximum angle side. When the solenoid-operated capacity control valve 34 is in the activated state, the refrigerant gas in the discharge chamber 132 is delivered to the control pressure chamber 121 through the pressure feed passage 33. Therefore, the pressure difference between the control pressure in the control pressure chamber 121 and the suction pressure on the opposite sides of the piston 23 becomes greater and the inclination angle of the swash plate 20 shifts to the minimum angle side.

Figure 4:
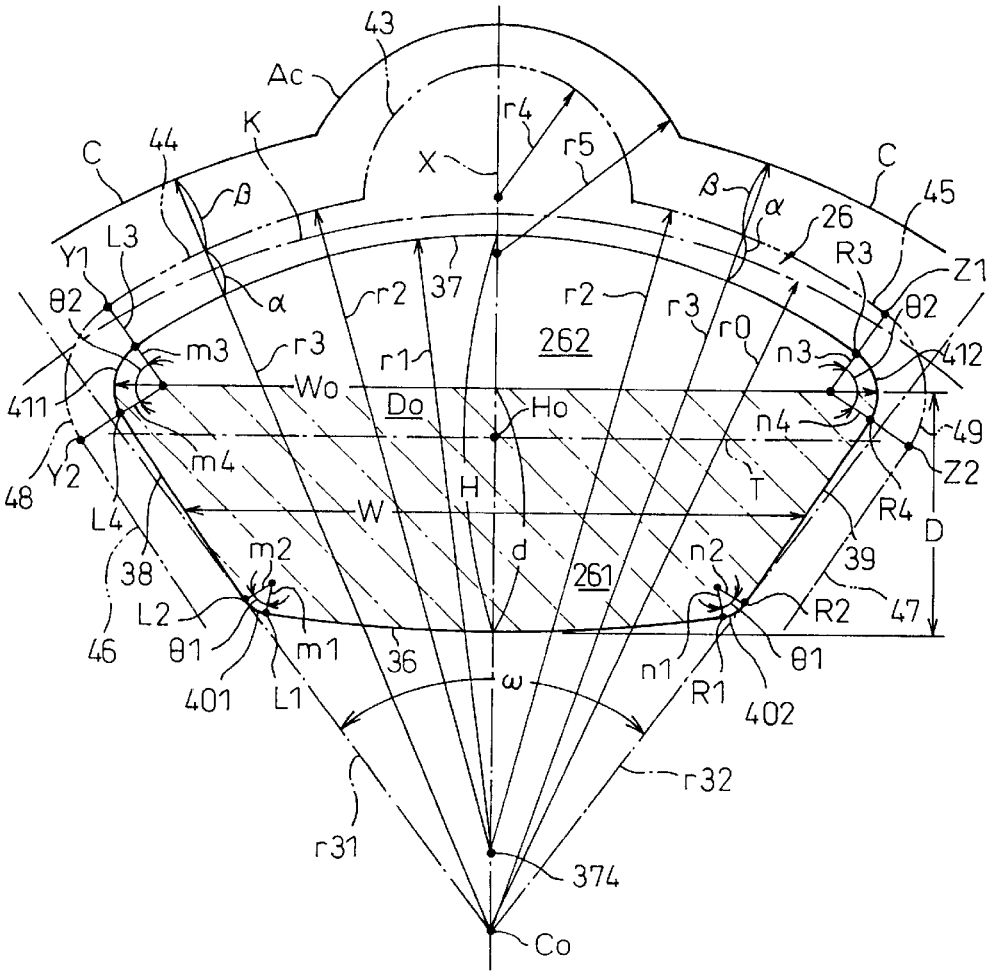
FIG. 4 is an enlarged view of the suction port and the suction valve.

FIG. 4 shows the valve closing condition where the suction valve 42 closes the suction port 26. The suction port 26 is formed in the shape similar to a sector with an apex portion of the sector removed. A contour line of the suction port 26 positioned on the contact surface 141 of the partition plate 14 includes a proximal end line 36 positioned on the side of the proximal end of the suction valve 42 (on the side of the window 421), a distal end line 37 positioned on the side of the distal end of the suction valve 42, a pair of right and left side lines 39 and 38, a first connection line 401 that interconnects the proximal end line 36 and the side line 38, another first connection line 402 that interconnects the proximal end line 36 and the side line 39, a second connection line 411 that interconnects the distal end line 37 and the side line 38, and another second connection line 412 that interconnects the distal end line 37 and the side line 39. The suction valve 42 has a symmetric shape with respect to a reference line X extending in the longitudinal direction of the suction valve 42, and the suction port 26 has a symmetric shape with respect to the reference line X. In other words, the left and right portions of the suction valve 42 and the suction port 26 are symmetric.

The proximal end line 36 is a convex curve slightly protruding from the distal end side of the suction valve 42 toward the proximal end side of the suction valve 42. The distal end line 37 is a convex curve protruding from the proximal end side of the suction valve 42 toward the distal end side of the suction valve. The side lines 38 and 39 are approximately straight lines extending substantially along the radial line r3 of the circle C associated with the circumferential surface 112 of the cylinder bore 111. The first connection line 401 is a curve smoothly connected to the proximal end line 36 and the side line 38 at positions L1 and L2, and another first connection line 402 is a curve smoothly connected to the proximal end line 36 and the side line 39 at positions $R_1$ and $R_2$. The second connection line 411 is a curve smoothly connected to the distal end line 37 and the side line 38 at positions L3 and L4, and another second connection line 412 is a curve smoothly connected to the distal end line 37 and the side line 39 at positions R3 and R4.

The bending angle θ2 of the second connection lines 411 and 412 is greater than the bending angle θ1 of the first connection lines 401 and 402. The bending angle θ1 represents an angle formed by normal lines m1 and m2 at the positions L1 and L2 and an angle formed by normal lines n1 and n2 at the positions R1 and R2. The bending angle θ2 represents an angle formed by normal lines m3 and m4 at positions L3 and L4 and an angle formed by normal lines n3 and n4 at positions R3 and R4.

In this embodiment, each of the proximal end line 36, the distal end line 37, the first connection lines 401 and 402 and the second connection lines 411 and 412 comprises a circular arc. The radius of curvature of the proximal end line 36 is greater than that of the distal end line 37.

As shown in FIGS. 1B and 4, the distal end portion of the suction valve 42 comprises an outer contour line extending along the distal end line 37, the second connection lines 411 and 412 and the side lines 38 and 39 of the suction port 26. The outer contour line of the distal end portion of the suction valve 42 comprises an arcuate engaging line 43 defining the outer profile of the engaging protrusion 422, a pair of right and left distal end forming lines 44 and 45, a pair of right and left side lines 46 and 47, a connection line 48 interconnecting the distal end forming line 44 and the side line 46, and a connection line 49 interconnecting the distal end line forming line 45 and the side line 47.

As shown in FIG. 4, the distal end forming lines 44 and 45 comprise an arcuate curve that is concentric with the arcuate distal end line 37 of the suction port 26. That is, the distance between the distal end line 37 of the suction port 26 and the distal end forming lines 44 and 45 of the suction valve 42 with respect to the direction of the arcuate radial lines r1 and r2 of the arcuate distal end line 37 and the distal end forming lines 44 and 45 is constant. The distance α between the distal end line 37 of the suction port 26 and the distal end forming lines 44 and 45 of the suction valve 42 with respect to the direction of the radial line r3 of the circle C of the cylinder bore 11 is not constant. However, the change of the gap α is only slight and is therefore substantially constant.

The side line 46 is a straight line parallel to the side line 38 of the suction port 26, and the side line 47 is a straight line parallel to the side line 39 of the suction port 26. The connection line 48 is an arcuate curve concentric with the arcuate second connection line 411 of the suction port 26. The connection line 49 is an arcuate curve concentric with the arcuate second connection line 412 of the suction port 26. The connection line 48 is a curve connected smoothly to the distal end forming line 44 and the side line 46 at positions Y1 and Y2. The connection line 49 is a curve connected smoothly to the distal end forming line 45 and the side line 47 at positions Z1 and Z2.

The radius of curvature of the arcuate distal end line 37 is slightly smaller than the radius of the circle C of the cylinder bore 111. The arc center 374 of the distal end forming lines 44 and 45 of the suction valve 42 is slightly shifted from the center Co of the circle C of the cylinder bore 111 towards the distal end of the suction valve 42 along the reference line X. Therefore, the gap β between the distal end forming lines 44, 45 of the suction valve 42 and the circle C of the cylinder bore 111 (the gap in the direction of the radial line r3 of the circle C of the cylinder bore 111) is not constant, but the change of the gap β is slight and the gap β is substantially constant.

The average of the gap β is greater than the gap γ (shown in FIG. 2) between the suction valve 42 and the distal end line 37 of the suction port 26 under the maximum valve open state.

The refrigerant gas passing through the suction port 26 from the side of the suction chamber 131 towards the side of the cylinder bore 111 flows between the contact surface 141 of the partition plate 14 and the suction valve 42 in the direction of the normal lines to the outer contour line of the suction port 26 or the contact surface 141 (the normal lines being represented by arrows N1, N2, N3 and N4 in FIG. 1B). The refrigerant gas flowing between the contact surface 141 and the suction valve 42 in the direction of the normal lines N2, N3 and N4 then flows from between the outer contour line of the suction valve 42 and the contact surface 141 towards the circumferential surface 112 of the cylinder bore 111. The refrigerant gas flowing between the contact surface 141 and the suction valve 42 in the direction of the normal line N1 then flows towards the window 421.

The first embodiment provides the following effects.

(1-1) The refrigerant gas flowing towards the distal end forming lines 44 and 45 in the direction of the normal line N2 then flows in the returning direction of the piston 23 from between the distal end forming lines 44 and 45 and the circumferential surface 112 of the cylinder bore 111. The distance α between the distal end forming lines 44 and 45 of the suction valve 42 and the distal end line 37 of the suction port 26 is substantially constant, and the distance β between the distal end forming lines 44 and 45 and the circumferential surface 112 of the cylinder bore 111 is substantially constant. In other words, the distance (α+β) between the distal end 37 of the suction port 26 and the circumferential surface 112 of the cylinder bore 111 in the direction of the radial line r2 is substantially constant. Therefore, according to the construction in which the distances α and β are substantially constant, the refrigerant gas flowing towards the circumferential surface 112 from between the suction valve 42 and the distal end line 37 of the suction port 26 is apt to impinge perpendicularly against the circumferential surface 112.

The gas flowing from between the suction valve 42 and the distal end line 37 of the suction port 26 towards the circumferential surface 112 of the cylinder bore 111 so as to perpendicularly impinge against the circumferential surface 112 is apt to flow from between the circumferential surface 112 of the cylinder bore 111 and the distal end forming lines 44 and 45 of the suction valve 42 in the returning direction of the piston 23 (in the direction from the right to the left in FIG. 5). That is, the refrigerant gas flowing in the direction perpendicular to the contour line of the suction port 26 close to the circumferential surface 112 of the cylinder bore 111 (the distal end line 37) is not apt to flow in the circumferential direction of the circumferential surface 112 of the cylinder bore 111. The suction port 26 and the suction valve 42 providing such a flow of the refrigerant gas improves easiness of the inflow of the cooling gas into the cylinder bore 111 and also improves compressor performance.

(1-2) The radius r4 of the arcuate engaging line 43 is smaller than the arcuate radius r5 of the circumferential side surface 281 of the maximum opening limiting recess 28, so that the distance between the engaging line 43 and the arc Ac of the side surface 281 at both ends thereof is great. Therefore, the refrigerant gas flowing towards the engaging line 43 of the engaging projection 422 in the direction of the normal line N2 can flow more easily between the end portions of the engaging line 43 and the end portions of the arc Ac of the side surface 281 in the returning direction of the piston 23. Such a flow of the refrigerant gas contributes to an improvement in the ease of the inflow of the refrigerant gas into the cylinder bore 111.

(1-3) As shown in FIG. 4, the suction port 26 is offset from the center Co of the circle C of the circumferential surface 112 of the cylinder bore 111. Two radial lines r31 and r32 of the radial lines r3 of the circle C of the circumferential surface 112 of the cylinder bore 111 are tangential to the outer contour line of the suction port 26, and form a predetermined angle ω with respect to the center Co of the circle C. The curve K in FIG. 4 is a part (arc) of a reference circle concentric with the circle C, and ro is one of the radial lines of the reference circle K. The reference circle K crosses the connection lines 48 and 49, but most part of the reference circle K exists between the contour line of the suction port 26 and the outer contour line of the suction valve 42 within the range of angle ω. Moreover, the reference circle K does not cross the distal end line 37 and the distal end forming lines 44 and 45. The arrangement in which most of the arc of the reference circle K, which passes between the distal end line 37 and the distal end forming lines 44 and 45 and is concentric with the circuit C, falls between the contour line of the suction port 26 and the outer contour line of the suction valve 42, provides a substantially constant gap α and a substantially constant gap β. The suction port 25 and the suction valve 42 that have substantially constant gaps α and β improve the ease of the inflow of the refrigerant gas into the cylinder bore 111.

(1-4) The average of the gap β between the circumferential surface 112 of the cylinder bore 111 and the distal end forming lines 44 and 45 of the suction valve 42 is greater than the gap γ between the suction valve 42 under the maximum valve opening condition and the distal end line 37 of the suction port 26. The portion of the gap γ between the suction valve 42 and the distal end line 37 is located on the upstream side of the portion of the gap β between the circumferential surface 112 of the cylinder bore 111 and the distal end forming lines 44 and 45 of the suction valve 42, with respect to the flow of the refrigerant gas. The construction in which the average of the gap β of the cooling gas passage portion located on the downstream side of the portion of the gap γ is greater than the distance γ makes it easy for the gas flowing perpendicularly impinge against the circumferential surface 112 of the cylinder bore 111 to flow in the returning direction of the piston 23.

(1-5) The area S encompassed by the proximal end line 36, the distal end line 37, the side lines 38 and 39 and the connection lines 401, 402, 411 and 412 is the flow sectional area of the suction port 26. When the suction port 26 is viewed in the reciprocating direction of the piston 23, a middle line T shown in FIG. 4 passes through the middle point Ho of the maximum length (represented by H in FIG. 4) of the suction port 26 in the longitudinal direction of the suction valve 42 (that is, in the direction of the reference line X), extends transversely with respect to the suction port 26, and perpendicularly crosses the reference line X extending in the longitudinal direction of the suction valve 42. When the suction port 26 is viewed in the reciprocating direction of the piston 23, the middle line T assumed in this way divides the suction port 26 into first and second sections 261 and 262. The area S2 of the second section 262 positioned on the distal end side of the suction valve 42 is greater than the area S1 of the first section 261. The greater the area S2 of the second section 262 is than the area S1 of the first section 261, the greater is the length of the contour line of the suction port 26 on the distal end side of the suction valve 42. In other words, the more the center of gravity of the area of the suction port 26 is shifted towards the distal end side of the suction valve 42, the greater is the length of the contour line of the suction port 26 on the distal end side of the suction valve 42.

The opening gap γ of the suction valve 42 relative to the partition plate 14 becomes greater towards the distal end of the suction valve 42, as shown in FIG. 2. Therefore, the greater the ratio of a portion of the refrigerant gas passing through the suction port 26 on the distal end side of the suction valve 42 is relative to a portion of the refrigerant gas passing through the suction port 26 on the proximal end side thereof, the higher is the degree of improvement in the easy inflow of the refrigerant gas into the cylinder bore 111 from the suction chamber 131. The longer the length of the contour line of the suction port 26 on the distal end side of the suction valve 42 is, the greater is the proportion of the flow of the refrigerant gas passing through the suction port 26 on the distal end side thereof relative to that on the proximal end side of the suction valve 42. Therefore, the construction in which the area S2 of the second section 262 is greater than the area S1 of the first section 261 enables the gas to more easily flow through the suction port 26 between the suction valve 42 on the distal end side of the suction valve 42 and the contact surface 141. As a result, the ease of inflow of the refrigerant gas when the refrigerant gas is sucked from the suction port 26 into the cylinder bore 111 can be improved, and the performance of the compressor can also be improved.

(1-6) The width of the suction port 26 (represented by W in FIG. 4) measured in the direction of the middle line T becomes gradually greater in the longitudinal direction of the suction valve 42 (in the direction of the reference line X) from the proximal end side to the distal end side of the suction valve 42, within the range D shown in FIG. 4. The region Do of the suction port 26 (hatched with chain hatching lines in FIG. 4) within the range D is a width increasing region where the width W becomes gradually greater in the direction of the reference line X from the proximal end side to the distal end side of the suction valve 42. The length d of the width increasing region Do in the direction of the reference line occupies a major part of the maximum length H of the suction port 26 in the direction of the reference line X. The existence of such a width increasing region Do is convenient for making the area S2 of the second section 262 greater than the area S1 of the first section 261, and the length of the contour line of the suction port 26 can be easily elongated as the width increasing region Do is disposed. Therefore, the existence of the width increasing region Do allows the refrigerant gas passing through the suction port 26 to more easily flow between the suction valve 42 and the contact surface 141 on the distal end side of the suction valve 42.

(1-7) The maximum width of the suction port 26 (represented by Wo in FIG. 4) in the direction of the middle line T exists in the second section 262. This maximum width Wo is greater than the maximum length H of the suction port 26 in the direction of the reference line X. The construction in which the maximum length H of the suction port 26 in the direction of the reference line X is smaller than the maximum width Wo of the suction port 26 in the direction of the middle line T is more advantageous for elongating the contour line of the suction port 26 on the distal end side of the suction valve 42 than the case where H>Wo. The closer the position of the maximum width Wo of the suction port 26 to the distal end of the suction valve 42, the more advantages it becomes to elongate the contour line of the suction port 26 on the distal end side of the suction valve 42. In other words, the construction in which the maximum length H of the suction port 26 in the direction of the reference line X is smaller than the maximum width Wo of the suction port 26 in the direction of the middle line T and the maximum width Wo exists in the second section 262 is convenient for elongating the length of the contour line of the suction port 26 on the distal end side of the suction valve 42.

(1-8) The distal end line 37 is longer than the proximal end line 36. The construction in which the distal end line 37 is longer than the proximal end line 36 enables the refrigerant gas passing through the suction port 26 to more easily flow towards the distal end side of the suction valve 42.

(1-9) The closer the distal end line 37 is to the circle C of the circumferential surface 112 of the cylinder bore 111, the greater is the opened gap γ between the distal end line 37 and the suction valve 42 under the valve open condition. The greater the gap γ is between the distal end line 37 and the suction valve 42, the easier it becomes for the refrigerant gas to flow into the cylinder bore 111. The distal end line 37 is an arc protruding outward from the proximal end side to the distal end side of the suction valve 42. The radius of curvature of the distal end line 37 is slightly smaller than the radius of the circle C of the circumferential surface 112 of the cylinder bore 111. The construction in which the distal end line 37 is the convex curve approximate to the circle C of the circumferential surface 112 of the cylinder bore 111 is advantageous for bringing the distal end line 37 closer to the circle C of the circumferential surface 112 of the cylinder bore 111.

(1-10) The pressure in the cylinder bore 111 urges the suction valve 42 against the periphery wall of the suction port 26, in the condition where the refrigerant gas in the cylinder bore 111 is discharged to the discharge chamber 132, and the suction valve 42 closes the suction port 26. In conjunction with the contour line of the suction port 26, the smaller the length of the contour line in the unit area, the more it becomes difficult for the refrigerant gas to leak from the cylinder bore 111 to the suction port 26 through the gap between the contact surface 141 and the suction valve 42. Supposing that a corner exists at a part of the contour line of the suction port 26, however, the length of the contour line in the unit area in the proximity of this corner becomes large. Therefore, the construction in which the corner exists at a part of the contour line of the suction port 26 is likely to invite the backflow of the refrigerant gas from the cylinder bore 111 to the suction port 26. The backflow of the refrigerant gas invites a drop in volumetric efficiency. The contour line of the suction port 26 comprising the proximal end line 36, the distal end line 37, the side lines 38 and 39, the first connection lines 401 and 402 and the second connection lines 411 and 412 becomes an annular line without any corner. The construction in which the contour line of the suction port 26 is an annular line without any corner is advantageous for preventing the refrigerant gas from back-flowing from the cylinder bore 111 to the suction port 26.

(1-11) The bending angle θ2 of the second connection lines 411 and 412 is greater than the bending angle θ1 of the first connection lines 401 and 402. Unless the shapes of the proximal end line 36, the distal end line 37 and the side lines 38 and 39 change greatly, the length of the distal end line 37 becomes progressively greater as the bending angle θ2 becomes progressively greater than the bending angle θ1. The construction in which the bending angle θ2 of the second connection lines 411 and 412 is greater than the bending angle θ1 of the first connection lines 401 and 402 is convenient as a construction for increasing the length of the distal end line 37.

(1-12) The closer the contour line of the suction port 26 on the distal end side of the suction valve 42 is to the circumferential surface 112 of the cylinder bore 111, the easier it becomes for the refrigerant gas to flow into the cylinder bore 111. Normally, the shapes of the suction valve 42 and the suction port 26 are set to symmetric shapes with respect to the reference line X, respectively. Then, the contour line of the suction port 26 on the distal end side of the suction valve 42 becomes symmetric with respect to the reference line X. When the distal end line 37, which is symmetric with the reference line X, is brought closer to the circumferential surface 112 of the cylinder bore 111 along the reference line X, the distal end line 37 can be brought most closely to the circumferential surface 112 of the cylinder bore 111 when the reference line X is in conformity with the radial line r3 of the circle C of the circumferential surface 112 of the cylinder bore 111. Therefore, the construction in which the reference line X is allowed to extend substantially along the radial line r3 of the circle C of the circumferential surface 112 of the cylinder bore 111 is advantageous for bringing the distal end line 37 closer to the circle C of the circumferential surface 112 of the cylinder bore 111.

(1-13) In the piston compressor, self-induced vibration may possibly occur during the shift of the suction valve from the position in which it closes the suction port to the maximum opening position, and this self-induced vibration invites suction pulsation. Suction pulsation causes the evaporator 32 in the external coolant circuit 29 to vibrate and to generate noise. In the variable capacity type compressor having the pistons 23, the pistons 23 reciprocate with strokes corresponding to the angle of inclination of the tiltable swash plate 20 so that the capacity becomes small when the angle of inclination of the swash plate 20 becomes small. The average gas flow rate through the suction ports is small under the low capacity condition, and the suction valves may not abut against the bottom surfaces 282 of the maximum opening limiting recesses 28. In consequence, self-induced vibration of the suction valve is likely to occur in the variable capacity type compressor.

In the construction in which the area S2 of the second section 262 is greater than the area S1 of the first section 261, the flow of the refrigerant gas flowing from the suction chamber 131 into the cylinder bore 111 is likely to more greatly concentrate on the distal end side remote from the proximal end of the suction valve 42, compared with the case of a suction port such as the one described in Japanese Unexamined Patent Publication (Kokai) No. 2000-54961, for example. Therefore, the suction valve 42 may abut against the bottom surface 282 of the maximum opening limiting recess 28 even under the low capacity condition, and self-induced vibration of the suction valve 42 will be less likely to occur.

Figure 6A:
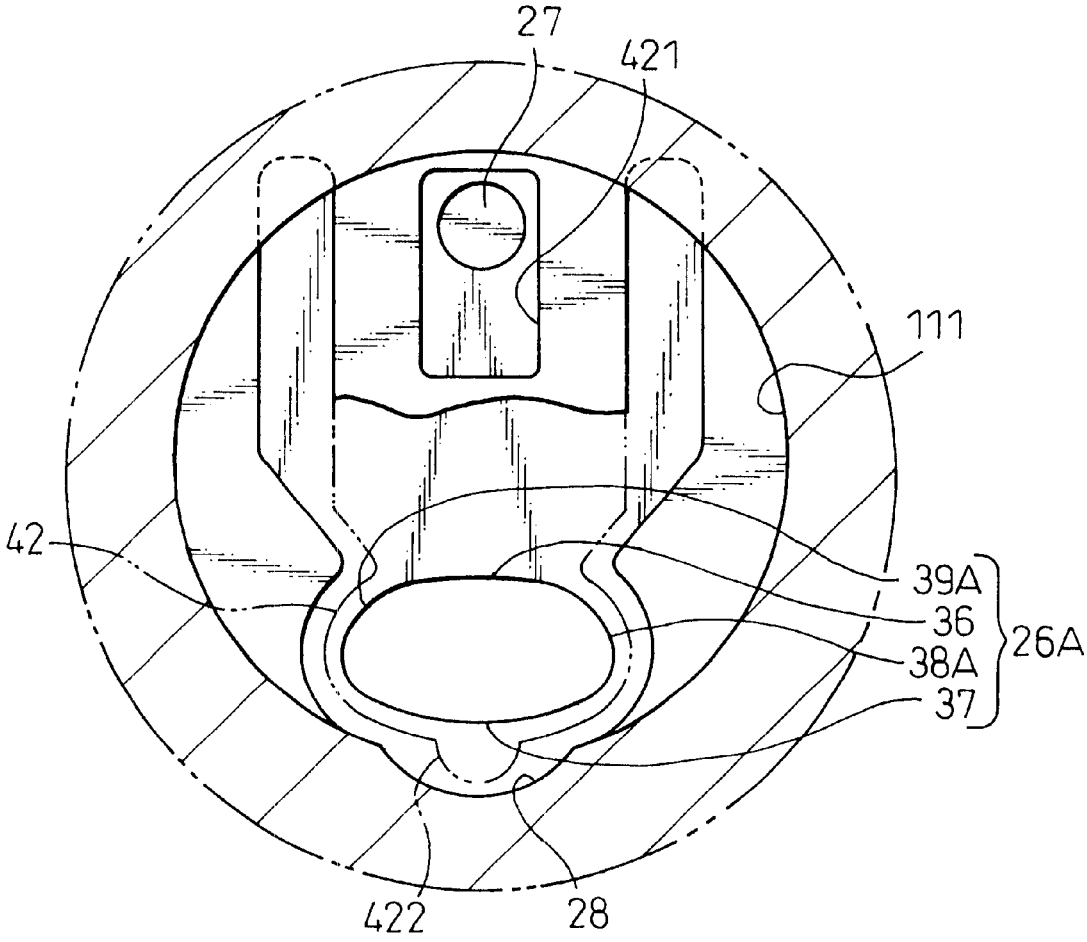
FIG. 6A is an enlarged sectional view of a compressor according to the second embodiment of the present invention.
Figure 6B:
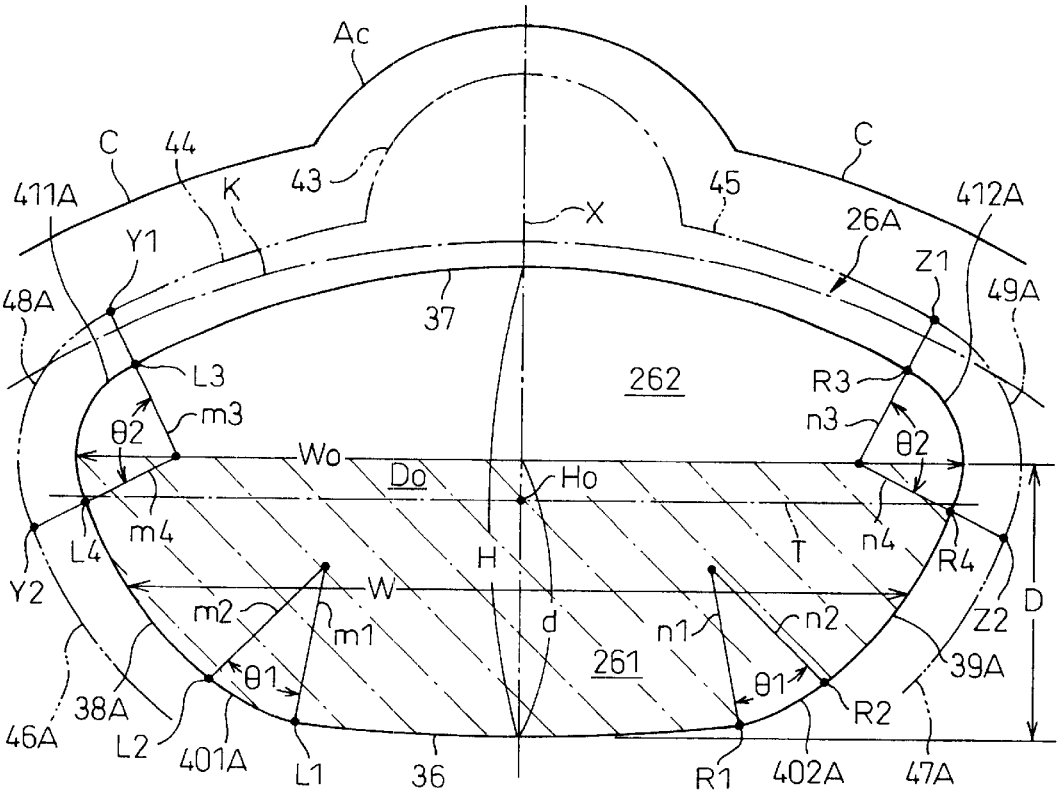
FIG. 6B is an enlarged view of the suction port and suction valve of FIG. 6A.

Next, the second embodiment of the present invention will be explained with reference to FIGS. 6A and 6B, in which like reference numerals are used to identify like elements in the first embodiment.

The contour line of the suction port 26A comprises the proximal end line 36, the distal end line 37, the curved side lines 38A and 39A, the first connection lines 401A and 402A, and the second connection lines 411A and 412A. The radius of curvature of each of the first and second connection lines 401A, 402A, 411A, and 412A is greater than the radius of curvature of the first connection lines 401 and 402 in the first embodiment. The contour line of such a suction port 26A is an annular line having no corner and no straight line. The outer contour line of the suction valve 42A on the distal end portion thereof comprises the engaging line 43, a pair of right and left distal end forming lines 44 and 45, a pair of right and left arcuate side lines 46A and 47A, the arcuate connection line 48A interconnecting the distal end forming line 44 and the side line 46, and the arcuate connection line 49A interconnecting the distal end line 45 and the side line 47A. The radius of curvature of the connection lines 48A and 49A is greater than the radius of curvature of the connection lines 48 and 49 in the first embodiment. The outer contour line of such a suction valve 42A on the distal end portion thereof is a line having no corner and no straight line.

The construction in which the contour line of the suction port 26A is an annular line having no corner and no straight line and the outer contour line of the suction valve 42A on the distal end portion thereof is a line having no corner and no straight line provides the same effect as that of the first embodiment. The construction in which the radius of curvature of the connection lines 401A, 402A, 411A and 412A is greater than the radius of curvature of the connection lines 401 and 402 in the first embodiment is much more advantageous than the first embodiment for preventing the refrigerant gas from back-flowing from the cylinder bore 111 to the suction port 26A.

Figure 7:
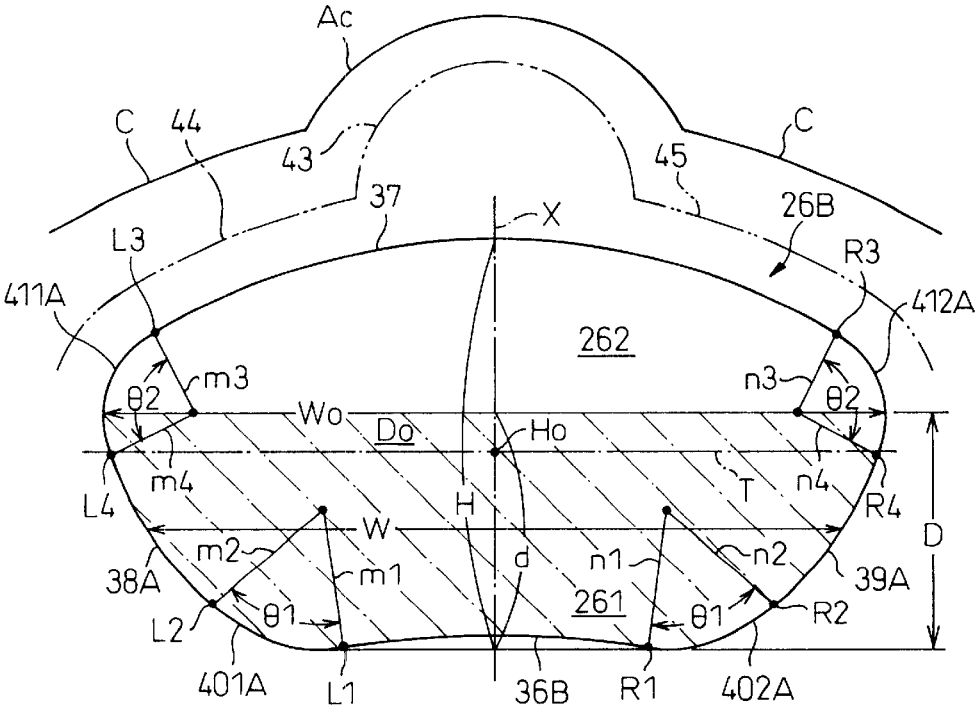
FIG. 7 is an enlarged view of the suction port and the suction valve according to the third embodiment.
Figure 8:
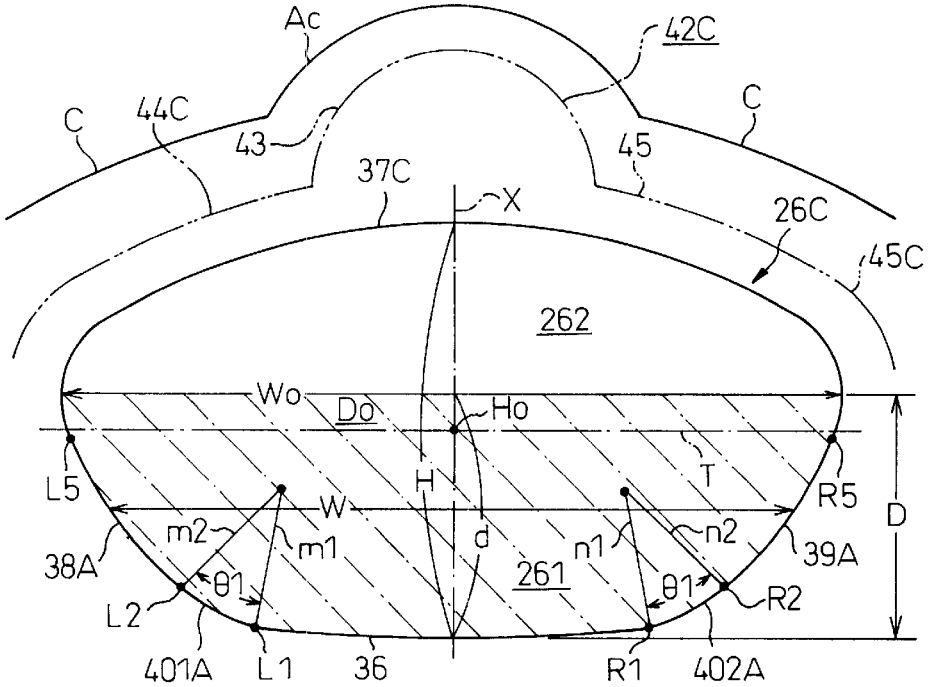
FIG. 8 is an enlarged view of the suction port and the suction valve according to the fourth embodiment.
Figure 9:
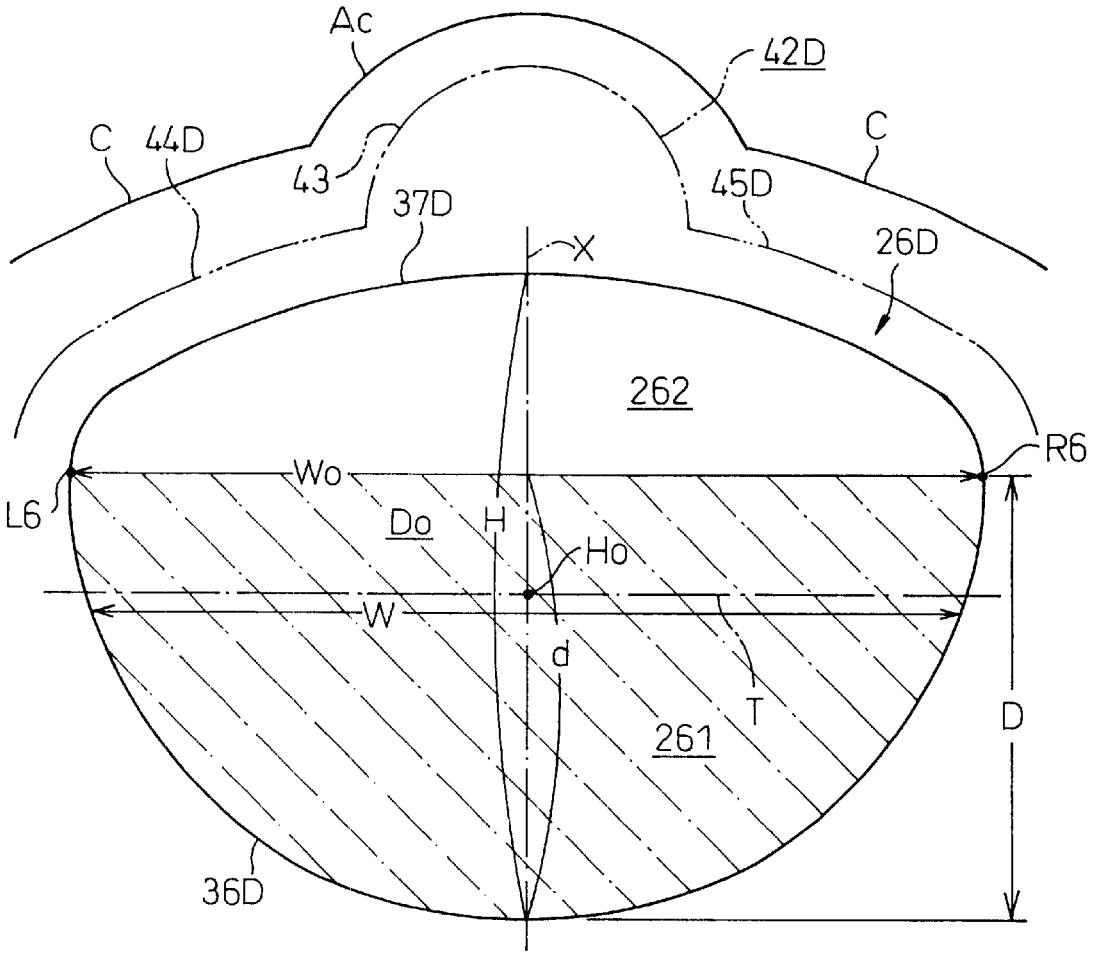
FIG. 9 is an enlarged view of the suction port and the suction valve according to the fifth embodiment.
Figure 10:
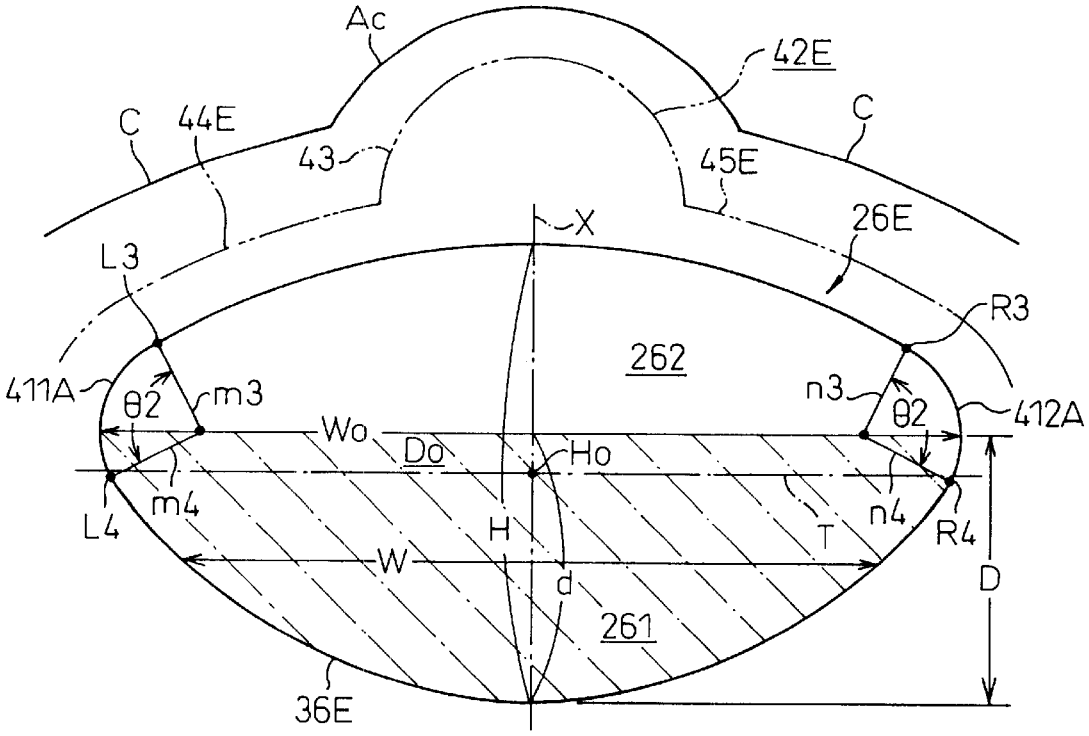
FIG. 10 is an enlarged view of the suction port and the suction valve according to the sixth embodiment.

FIG. 7 shows the third embodiment and FIG. 8 shows the fourth embodiment. FIG. 9 shows the fifth embodiment and FIG. 10 shows the sixth embodiment. Like reference numerals are used in these drawings to identify like elements in the first and second embodiments.

The proximal end line 36B of the suction port 26B shown in FIG. 7 is a concave curve recessed from the proximal end side to the distal end side of the suction valve 42A.

The distal end line 37C of the suction port 26C shown in FIG. 8 is a part of an ellipse. The distal end line 37C and a pair of side lines 38A and 39A are smoothly connected at positions L5 and R5. Reference numerals 44C and 45C denote distal end forming lines of the suction valve 42C.

The proximal end line 36D of the suction port 26D shown in FIG. 9 is a part of a circle and the distal end line 37D is a part of an ellipse. The proximal end line 36D and the distal end line 37D are connected smoothly at positions L6 and R6. Reference numerals 44D and 45D denote the distal end forming lines of the suction valve 42D.

The suction port 26E shown in FIG. 10 represents the shape formed by inverting the suction port described in Japanese Unexamined Patent Publication (Kokai) No. 2000-54961 in the direction of the reference line X. The proximal end line 36E of the suction port 26E is smoothly connected to a pair of connection lines 411A and 412A. Reference numerals 44E and 45E denote the distal end forming lines of the suction valve 42E.

Figure 11:
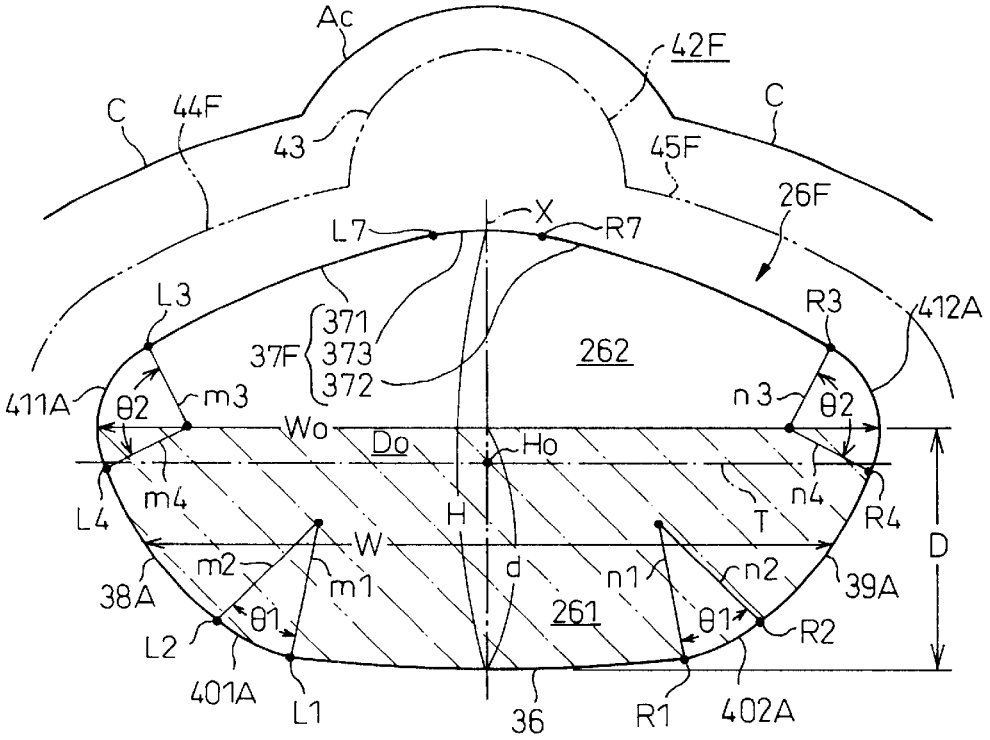
FIG. 11 is an enlarged view of the suction port and the suction valve according to the seventh embodiment.

The distal end line 37F of the suction port 26F in FIG. 11 comprises a first distal end line 371, a second distal end line 372 and a connection line 373. The connection line 373 is smoothly connected to the first distal end line 371 and the second distal end line 372 at positions L7 and R7. Reference numerals 44F and 45F denote the distal end forming lines of the suction valve 42F.

Figure 12:
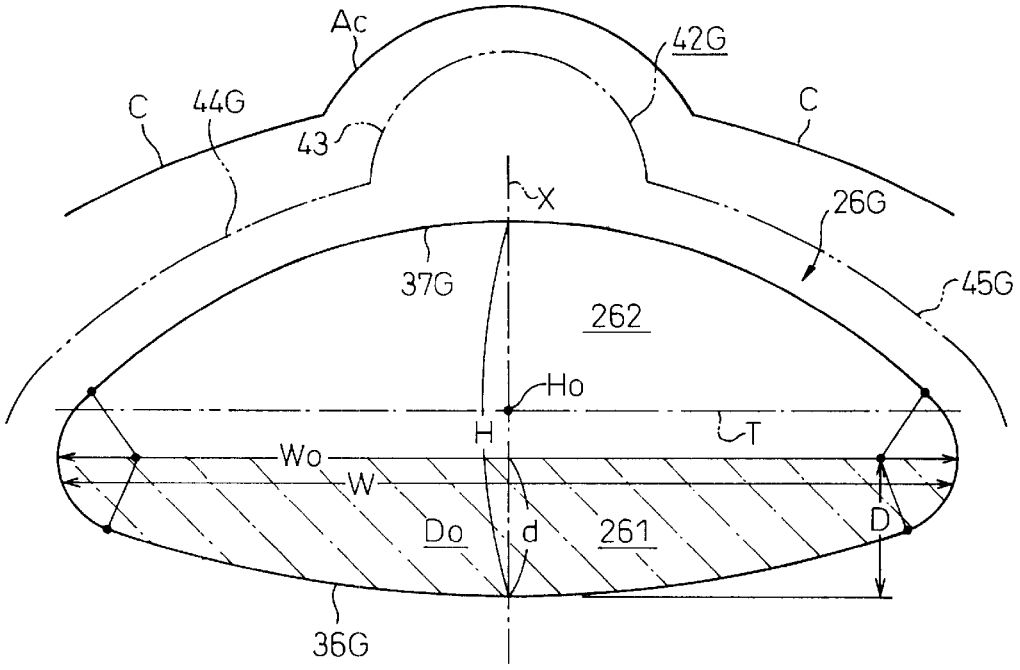
FIG. 12 is an enlarged view of the suction port and the suction valve according to the eighth embodiment.

The distal end line 37G of the suction port 26G shown in FIG. 12 is a part of a circle, and the proximal end line 36G is a part of an ellipse. The distal end line 37G and the proximal end line 36G are smoothly connected at positions L8 and R8. Reference numerals 44G and 45G denote the distal end forming lines of the suction valve 42G.

The distal end lines 37, 37C, 37D, 37F and 37G of the suction ports 26B, 26C, 26D, 26E, 26F and 26G in the embodiments shown in FIGS. 7 to 12 and the distal end forming lines 44, 45, 44C, 45C, 44D, 45D, 44E, 45E, 44F, 45F, 44G and 45G of the suction valves 42, 42A, 42C, 42D, 42E and 42F have the same relationship with the first embodiment regarding the distances $\alpha$, $\beta$ and $\gamma$ and the reference circle K. The forming lines of the suction ports 26B to 26F in the embodiments shown in FIGS. 7 to 11 provide the same condition as the suction port 26 of the first embodiment as to the size of the first and second areas S1 and S2 of the first and second section ranges 261 and 262, the length relationship of the maximum length H and the width Wo and the relationship of the length d of the width increasing region Do and the maximum length H.

Incidentally, the present invention can also be applied to suction ports having an asymmetric shape with respect to the reference line. The shape of the engaging line of the suction valve is not limited to the circular arc but may have an arbitrary convex shape.

As described above in detail, in the present invention, the outer contour line of the distal end portion of the suction valve and the contour line of the distal end portion of the suction port are disposed to extend along the circle of the circumferential surface of the cylinder bore, the gap between the distal end outer contour line of the suction valve and the distal end contour line of the suction port in the direction of the radial line of the circle of the outer circumferential surface of the cylinder bore is kept substantially constant, and the gap between the distal end outer contour line of the suction valve and the circumferential surface of the cylinder bore in the direction of the radial line is kept substantially constant. Therefore, the present invention provides the excellent effect in which facility of the inflow of the gas (lack of resistance of inflow to the gas) can be improved when the gas is sucked from the suction port to the cylinder bore.

What is claimed is:

1. A piston type compressor comprising:

a housing having cylinder bores, a suction chamber, a discharge chamber, suction ports and discharge ports formed therein;

pistons reciprocatingly arranged in said cylinder bores;

a drive shaft rotatably supported by said housing;

a transmission mechanism operatively coupled to said drive shaft and said pistons for converting rotation of said drive shaft into reciprocal movement of the pistons;

suction valves to open and close the suction ports;

discharge valves to open and close the discharge ports;

wherein each said suction valve has a proximal end portion and a distal end portion on the opposite side of the proximal end portion, said distal end portion of said suction valve having an outer contour line including a distal end forming line located near a circumferential surface of said cylinder bore and side lines located on either side of said distal end forming line, each said suction port having a contour line including a distal end line located near the circumferential surface of the cylinder bore and side lines located on either side of said distal end line; and said distal end forming line of said suction valve and said distal end line of said suction port being arranged along said circumferential surface of said cylinder bore, so that a gap between said distal end forming line and said distal end line with respect to a radial line of a circle forming the circumferential surface of the cylinder bore is substantially constant and a gap between said distal end forming line and said circumferential surface of said cylinder bore with respect to said radial line is substantially constant.

2. A piston type compressor according to claim 1, wherein an average of said gap between the circumferential surface of said cylinder bore and said outer end forming line of said suction valve is greater than a gap between said suction valve and said distal end line of said suction port under a maximum valve open condition.

3. A piston type compressor according to claim 2, wherein a middle line is provided which passes through a middle point of a maximum length of said suction port in a longitudinal direction of said suction valve, extends transversely with respect to said suction port and perpendicularly crosses a reference line extending in the longitudinal direction of said suction valve, said middle line dividing said suction port into a first section positioned on the side of the proximal end of said suction valve and a second section positioned on the side of said distal end of said suction valve, an area of said second section being greater than an area of said first section.

4. A piston type compressor according to claim 3, wherein a width increasing region is disposed in which the width of said suction port in a direction of said middle line becomes gradually greater from the proximal end side to the distal end side of said suction valve in the longitudinal direction of said suction valve, and the length of said width increasing region in the direction of said reference line occupies a major part of the maximum length of said suction port in the direction of said reference line.

5. A piston type compressor according to claim 4, wherein a maximum width of said suction port in the direction of said middle line exists in said second section and is greater than a maximum length of said suction port in the direction of said reference line.

6. A piston type compressor according to claim 3, wherein the contour line of said suction port includes a proximal end line positioned on the side of the proximal end of said suction valve, said distal end line, and a pair of right and left side lines, and said distal end line is longer than said proximal end line.

7. A piston type compressor according to claim 6, wherein said contour line of said suction port includes a pair of first connection lines connecting said proximal end line to said pair of side lines, and a pair of second connection lines connecting said distal end line to said pair of side lines, said pair of first connection lines being smoothly connected to said proximal end line and said pair of said side lines, said pair of second connection lines being smoothly connected to said distal end line and said pair of side lines.

8. A piston type compressor according to claim 1, wherein said contour line of said suction port is an annular convex curve with no corner.

9. A piston type compressor according to claim 3, wherein said reference line extends substantially along the radial line of the circle of the circumferential surface of said cylinder bore.

10. A piston type compressor according to claim 1, wherein the suction port is formed in the shape of a portion of a sector with an apex portion of a sector removed.

* * * * *